US005554050A

United States Patent [19]

Marpoe, Jr.

[11] Patent Number: 5,554,050

[45] Date of Patent: Sep. 10, 1996

[54] FILTERING INSERT FOR ELECTRICAL CONNECTORS

[75] Inventor: Gary R. Marpoe, Jr., Kernersville, N.C.

[73] Assignee: The Whitaker Corporation, Wilmington, Del.

[21] Appl. No.: 401,594

[22] Filed: Mar. 9, 1995

[51] Int. Cl.[6] ..... H01R 13/66

[52] U.S. Cl. ..... 439/620; 333/181; 333/182; 439/941; 439/95

[58] Field of Search ..... 439/620; 333/181, 333/182, 183, 184, 185, 941, 95

[56] References Cited

U.S. PATENT DOCUMENTS

| | | | |
|---|---|---|---|
| 4,020,430 | 4/1977 | Vander Heyden | 439/620 |
| 4,473,755 | 9/1984 | Imai et al. | 307/10 R |
| 4,600,256 | 7/1986 | Anttila | 339/17 M |
| 4,660,907 | 4/1987 | Belter | 439/620 |
| 4,673,237 | 6/1987 | Wadsworth | 439/607 |
| 4,682,129 | 6/1987 | Bakermans et al. | 333/184 |
| 4,726,638 | 2/1988 | Farrar et al. | 439/620 R |
| 4,726,790 | 2/1988 | Hadjis | 439/630 |
| 4,729,752 | 3/1988 | Dawson, Jr. et al. | 439/620 |
| 4,875,865 | 10/1989 | Demler, Jr. et al. | 439/101 |
| 4,930,200 | 6/1990 | Brush, Jr. et al. | 29/25.42 |
| 4,931,754 | 6/1990 | Moussie | 333/184 |
| 4,959,626 | 9/1990 | Moussie | 333/182 |
| 5,082,457 | 1/1992 | Wollscheidt | 439/620 |
| 5,141,455 | 8/1992 | Ponn | 439/620 |
| 5,150,086 | 9/1992 | Ito | 333/182 |
| 5,152,699 | 10/1992 | Pfeifer | 439/620 |
| 5,153,540 | 10/1992 | Gliha et al. | 333/182 |
| 5,181,859 | 1/1993 | Foreman et al. | 439/225 |
| 5,290,191 | 3/1994 | Foreman et al. | 439/95 |
| 5,340,334 | 8/1994 | Nguyen | 439/620 |
| 5,344,342 | 9/1994 | Briones | 439/620 |

OTHER PUBLICATIONS

"Tiny Filter quashes GMI," *Design News*, Jan. 17, 1994, p. 37.

μDisc GMI Filter Wafer, TRW Advertisment, Rev. 083193, 1993.

AMP Customer Drawing 770396 (2 sheets).

*Primary Examiner*—P. Austin Bradley
*Assistant Examiner*—T. C. Patel
*Attorney, Agent, or Firm*—Timothy J. Aberle

[57] ABSTRACT

An electrical connector assembly includes two mating multiposition electrical connector halves 2, 4 and an insert 10 which is positioned in engagement with the terminals 8 in one of the connector halves. The insert is fabricated from a lead frame 16 which is secured between an insulative substrate 40 and a cover 48. Portions of the lead frame 16 extending into slots 44 and channels 52 on the substrate and cover are punched out to separate connecting tabs 26 from ground buses 18, 20, 22. Surface mount capacitors 38 are soldered to both the solder tab sections 30 on the connecting tabs and to solder contact sections 34 on the ground buses. The insert 10 is then positioned on the terminals 8 on one connector half with the tines 32 in a terminal socket 28 on each connecting tab 26 engaging the terminals 8.

24 Claims, 10 Drawing Sheets

FILTERING INSERT FOR ELECTRICAL CONNECTORS

BACKGROUND OF THE INVENTION

1. Field of the Invention

This invention relates to the addition of an insert to an electrical connector to alter the characteristics of the circuits to which that connector is attached. More specifically, this invention relates to filtering inserts which can be used with electrical connectors to filter noise on the circuit. Even more specifically, this invention relates to the use of stamped and formed and molded components to fabricate the filtering inserts.

2. Description of the Prior Art

One technique for filtering undesirable noise on a circuit or one or more individual lines is to install a capacitive element between that line or circuit and ground. One prior art approach to adding a filtering component is to incorporate that component into an electrical connector in the circuit. One approach to adding the filtering component to an electrical connector is to mount surface mount capacitors on printed circuit boards which are shaped to mount either between mating electrical connectors or to be mounted at the rear of one of the connector halves, often on a printed circuit board header connector. Examples of this approach are shown in U.S. Pat. No. 5,181,859 and in U.S. Pat. No. 5,290,191. These prior art devices use standard surface mount capacitors soldered to traces on small printed circuit boards and add pin contact terminals to the printed circuit board to establish electric contact with the terminals of the connector to which filtering is to be added. These terminal contacts must however be added to the printed circuit board and care must be taken that there is not only a reliable contact to board interface, but also that this interface is not damaged during other processing steps or when the surface mount components are added.

SUMMARY OF THE INVENTION

A filtering insert which can be attached to an electrical connector includes stamped and formed connecting tabs and ground buses which are secured to a substrate. Filter components are soldered between the connecting tabs and a corresponding ground bus. The connecting tabs include a socket and a solder tab section. Each ground bus includes a solder contact section which is aligned with a corresponding solder tab section on the connecting tabs. Each filter component, preferably in the form of a standard surface mount component such as a surface mount capacitor, is soldered using conventional surface mount soldering techniques. The socket on each connecting tab is resilient and establishes a resilient electrical connection with a corresponding terminal when the filtering insert is attached a connector.

The connecting tabs and ground buses are initially parts of a lead frame which is preferably secured by a cover to an insulative substrate, which in the preferred embodiments is a molded member. Portions of the lead frame initially connecting the connecting tabs to the ground buses are punched out after the lead frame is secured to the substrate. Aligned slots and channels in the substrate and cover provide clearance for the punching tool. The disconnected connecting tabs are thus held in place by the substrate or the substrate and the cover. Sections on the opposite sides of the punched out portions have solder deposits and the surface mount components are soldered to these solder deposits.

By fabricating the filtering insert in this manner it is possible to use conventional stamping and forming techniques to fabricate the filter insert assembly. No special manufacturing operations of any kind are required. Only one soldering operations is necessary and no special terminals must be added. A resilient contact can be established with the terminals in a conventional connector without the need of any hybrid soldering operations. A standard filter insert connector can be fabricated which can be subsequently loaded with individual surface mount filter components. Alternatively other components, besides filtering components can be added.

Many different configurations can be fabricated using this approach. It is applicable both to filtered and unfiltered configurations. Although especially useful when used in conjunction with printed circuit board connectors, this type of connector and its assembly method are not so limited. This invention is suitable for retrofitting standard connectors where is becomes necessary, after the fact, to add filtering, and it is also suitable to use in entirely new connector designs.

These and other objects of this invention are achieved in the manner depicted by the representative embodiments disclosed herein.

BRIEF DESCRIPTION OF THE DRAWINGS

FIG. 3 is a rear perspective view of the filtering insert shown in FIG. 2.

FIG. 13 is an exploded perspective view similar to FIG. 1, showing a second embodiment in which the filtering insert is positioned on the rear of the header housing and showing one version of a shielded header.

DETAILED DESCRIPTION OF THE PREFERRED EMBODIMENTS

Figure 1:
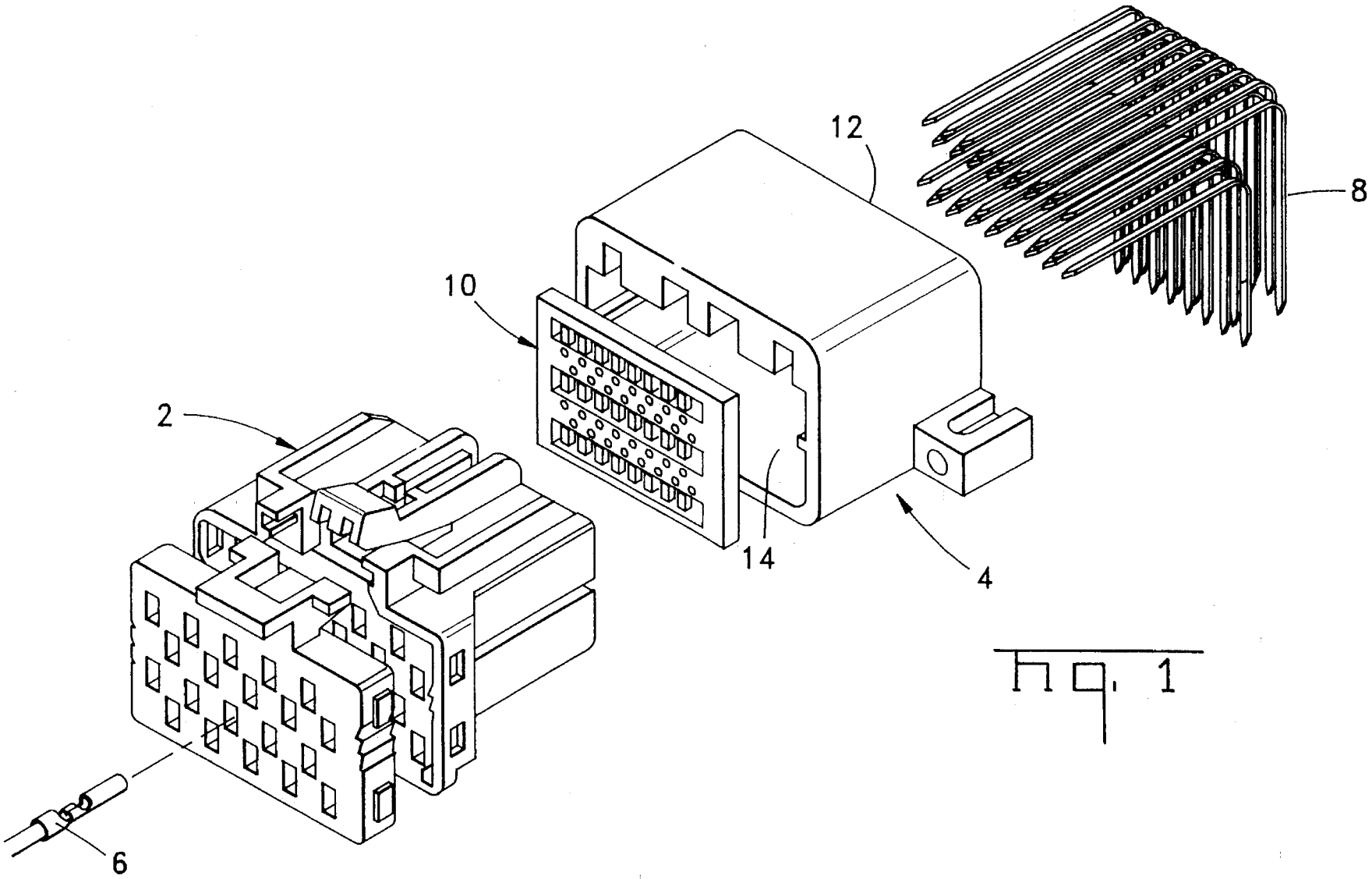
FIG. 1 is an exploded perspective view showing a first embodiment of a filtering insert and the electrical connector receptacle and a mating connector header with which the filtering insert is to be used.

The filtering insert approach disclosed herein in the form of two representative embodiments can be used with numerous electrical connector configurations to add filtering to circuits in which these otherwise substantially conventional electrical connectors would be used. Each of the two embodiments depicted herein is used with a conventional electrical connector configuration consisting of a multiposition electrical connector receptacle in which electrical terminals attached to individual wires are positioned in the connector in multiple rows of staggered terminals. The connector receptacles mate with electrical connector printed circuit board headers containing multiple printed circuit board pins. Although right angle mount headers are shown, this invention can be employed with straight pins in vertical mount headers. The term pin as used herein is intended to refer to male terminals in general and is not limited to specific configurations. For example, pins can have different cross sections including square or circular cross sections, and pins can be solid or formed pins, open in the center. This invention can also be used with other electrical connector configurations and is not limited to use with printed circuit board connectors. For instance this invention can be used with wire to wire pin and socket type electrical connectors. The modifications to the embodiments depicted herein would consist basically in redimensioning the connection to be made with the specific alternative electrical terminal used in other embodiments. This redesign could be performed without undue experimentation by one of ordinary skill in the art. This invention is also not limited to use with the rectangular configurations depicted in the two representative embodiments. For example a circular filtering insert could be used with circular connectors. The terminals also need not be configured in the staggered configurations shown in the representative embodiments. This invention can also be employed with either noble metal plated electrical terminals or with tin plated electrical terminals.

The first representative embodiment of this invention shown in FIGS. 1–12 is a filtering insert 10 which can be mounted at the mating interface between an electrical connector receptacle 2 and a printed circuit board header 4. This connector assembly in intended to connect a plurality of individual wires terminated to female electrical contact terminals 6 to circuits on a printed circuit board through individual male terminal pins 8, each arranged here in four staggered rows. In this embodiment, adjacent terminals are spaced apart on centerlines of 3.00 mm. The pins 8 extend through the housing of the header 4 from a rear surface 12 to a mating surface 14, here in the form of a shrouded configuration in which the mating end of the connector receptacle 2 is received within the shroud at the mating face. The filtering insert is positioned on the pins 8 at the mating face 14 prior to mating the two connectors halves.

Figure 2:
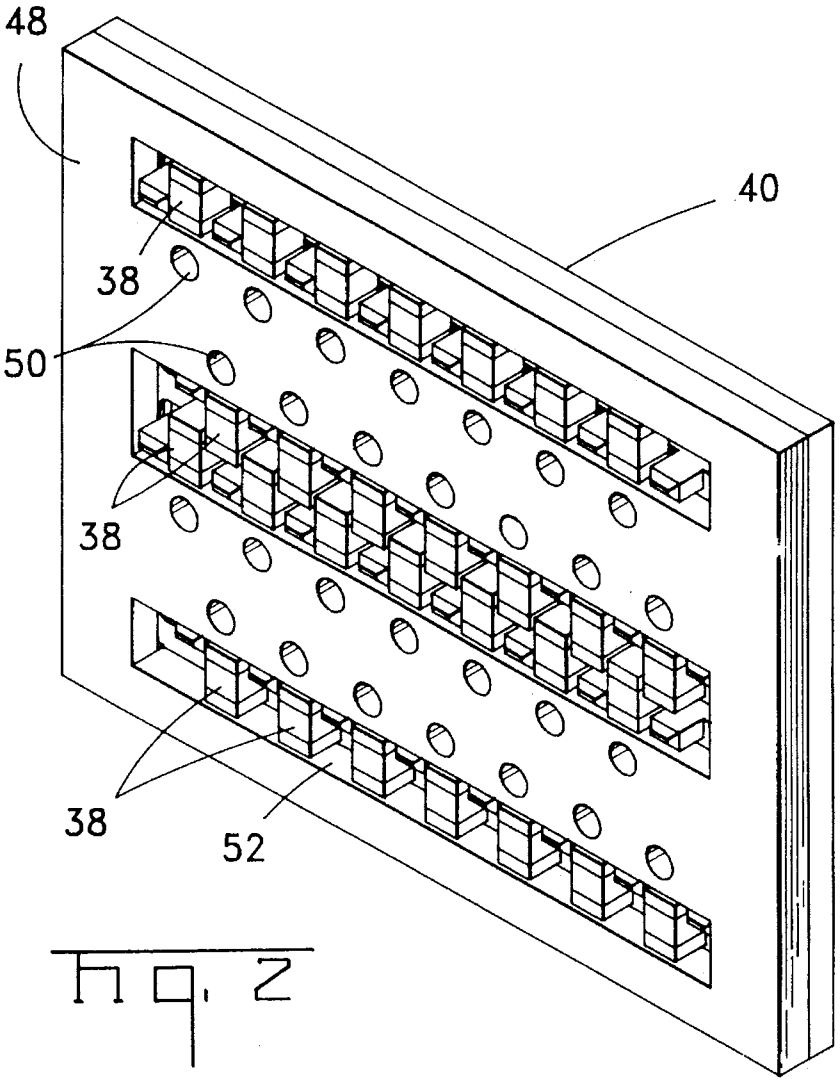
FIG. 2 is a front view of a filtering insert showing the position of surface mount capacitors used as filtering components in the first embodiment of this invention.

In the embodiment of FIG. 1, discrete filtering components are positioned on filtering insert 10 between signal lines to be filtered and ground. This configuration with the filtering components 38 on the filtering insert 10 is shown in FIG. 2. In this embodiment, the filtering inserts are discrete surface mount capacitors of conventional construction. For example, EIA standard ceramic capacitors in an 0805 package having a length of 2.0 mm (0.080 in.), a width of 1.2 mm (0.050 in.), and a height of 1.2 mm (0.050 in.) could be used.

Figure 4:
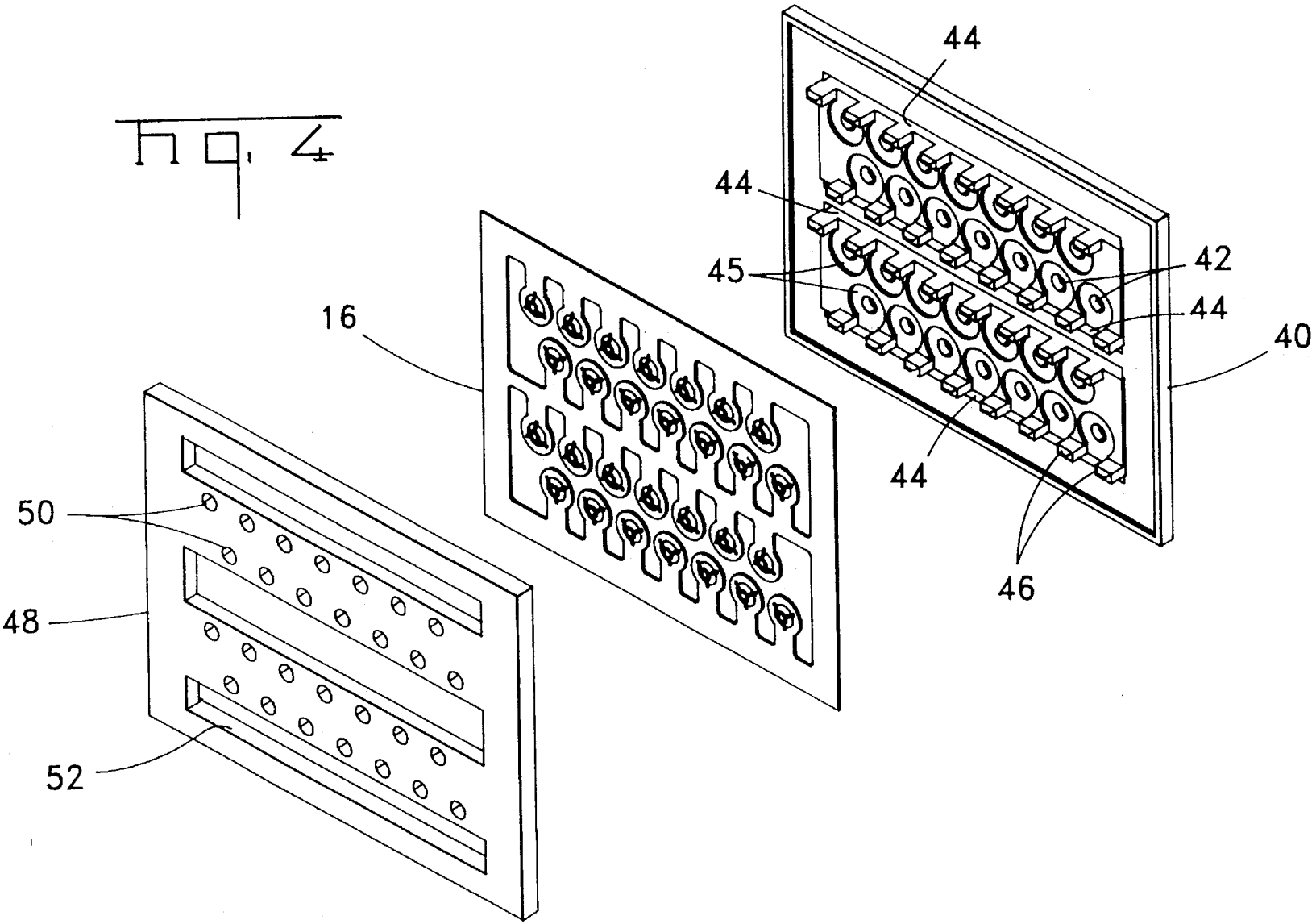
FIG. 4 is an exploded perspective, viewed from the front, showing the major components of the filtering insert.
Figures 5, 7:
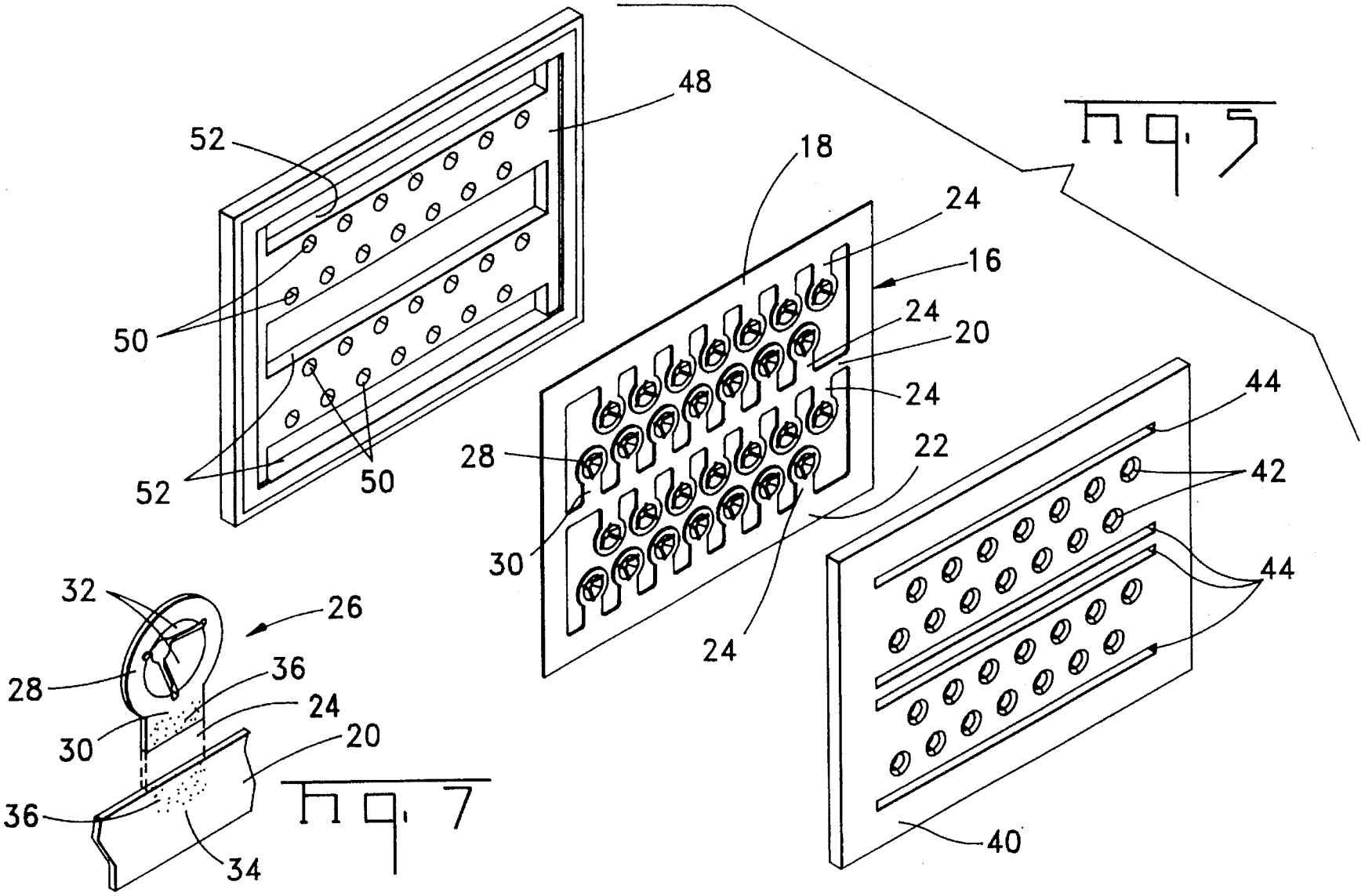
FIG. 5 is a rear perspective view of the components of the filtering insert shown in FIG. 4.
Figure 6:
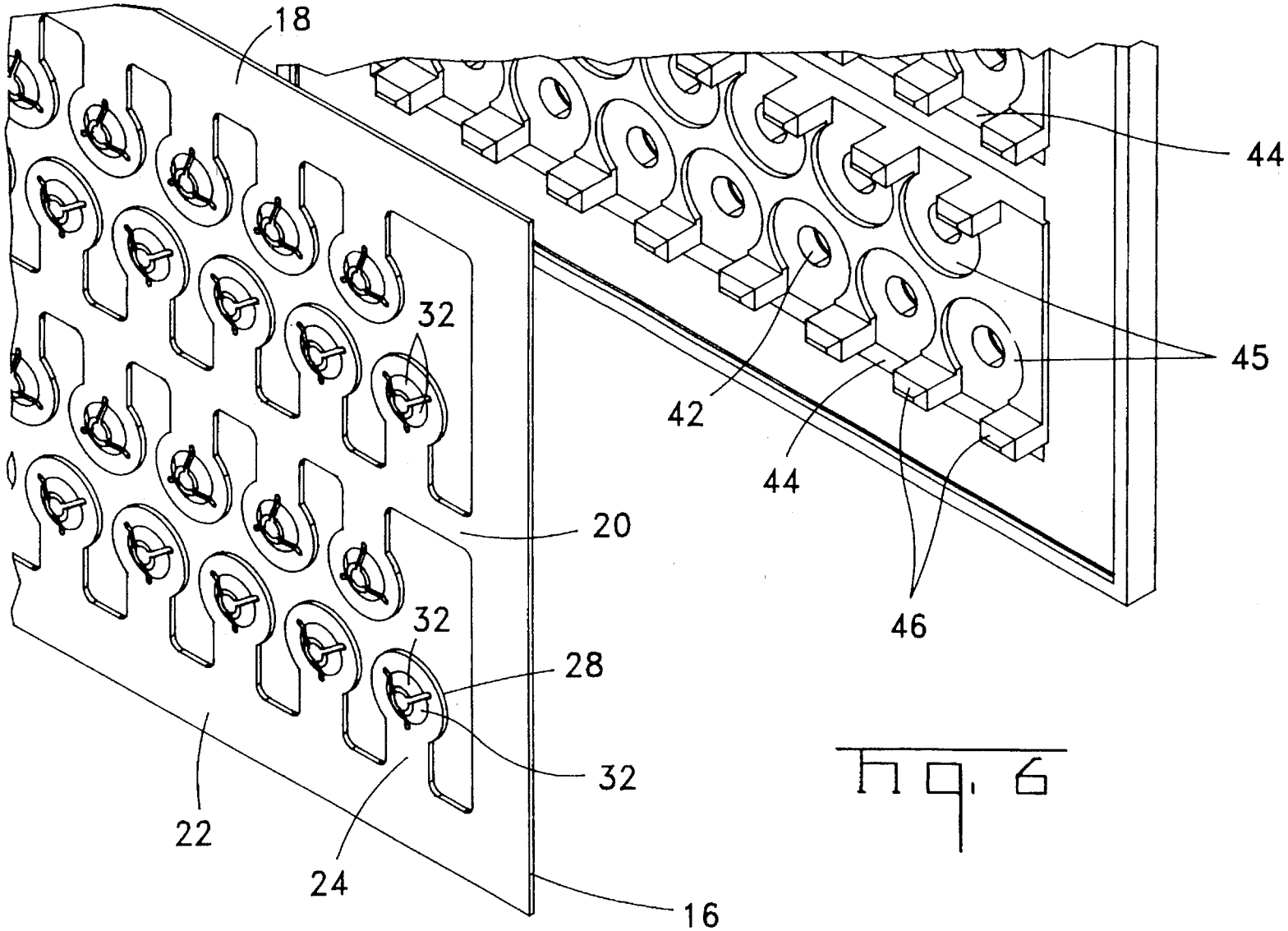
FIG. 6 is an enlarged view, from the same perspective as FIG. 4, showing details of the lead frame and the insulative substrate.

These filter components are mounted on a filtering insert subassembly which is fabricated from a lead frame 16 which is mounted between an insulative substrate 40 and a cover 48. These components are shown in FIGS. 4–6. FIGS. 4 and 5 are front and rear views respectively of the lead frame 16, the insulative substrate 40 and the cover 48. The lead frame 16 is stamped and formed from a flat metal blank in a conventional manner from a metal having spring properties. Any number of standard engineering metals, for brass or various copper alloys, could be employed. The insulative substrate 40 and the cover 48 are each molded using any number of standard engineering plastics including thermoplastics and thermosets. These plastics should be compatible with the temperatures encountered during surface mount soldering operations.

The lead frame 10 is stamped in a configuration to match the terminal arrangement in the connector with which the filter insert 10 is to be used. In this embodiment, the connector is a four row connector with staggered pins, so the lead frame is stamped in a four row configuration. This embodiment of the lead frame has three horizontal carrier strips 18, 20, 22. A plurality of carrier strip extensions 24 extend from each carrier strip, and connecting tabs 26 will be subsequently formed from these extensions 24. Each of the extensions 24 has a generally circular or ring section located at the end of the extension. A terminal socket 28 is formed at the ends of the extensions 24. The preferred embodiment of this terminal socket 28 is formed by stamping each extension to form a central opening surrounded by a plurality in inwardly extending tines 32. These tines 32 are formed transverse to the plane of the lead frame, and each tine 32 comprises a resilient spring which will establish electrical contact with a terminal, such a printed circuit board pin 8, inserted through the socket 28. Openings 50 in the cover 48 provide sufficient clearance for the portions for the tines 32 formed out of the plane of the lead frame 10. These tines are preferably formed in a progressive die in which a continuous strip of lead frames are fabricated.

The molded insulative substrate 40 has an inner face in which the lead frame 16 can be mounted in its integral configuration shown in FIGS. 4 and 5. The substrate 40 has a plurality of substrate terminal openings 42 which extend from the front to the rear faces of the substrate 40. Four slots 44 extend parallel to the rows of substrate terminal openings 42 and are mutually parallel. These four slots 44 are best seen in FIG. 5. The slots 44 are visible in FIG. 4, but the rear edge on these slots 44 on the rear face is not visible in FIG. 4 or in the enlarged view of FIG. 6. The inner face is recessed at indentations 45 which are shaped to receive the rounded ends of extensions 24 on the lead frame 10. The substrate terminal openings 42 extend through these indentations and separation or alignment posts 46 are located along the edge of the slots 44 between adjacent indentations 45.

Figure 8:
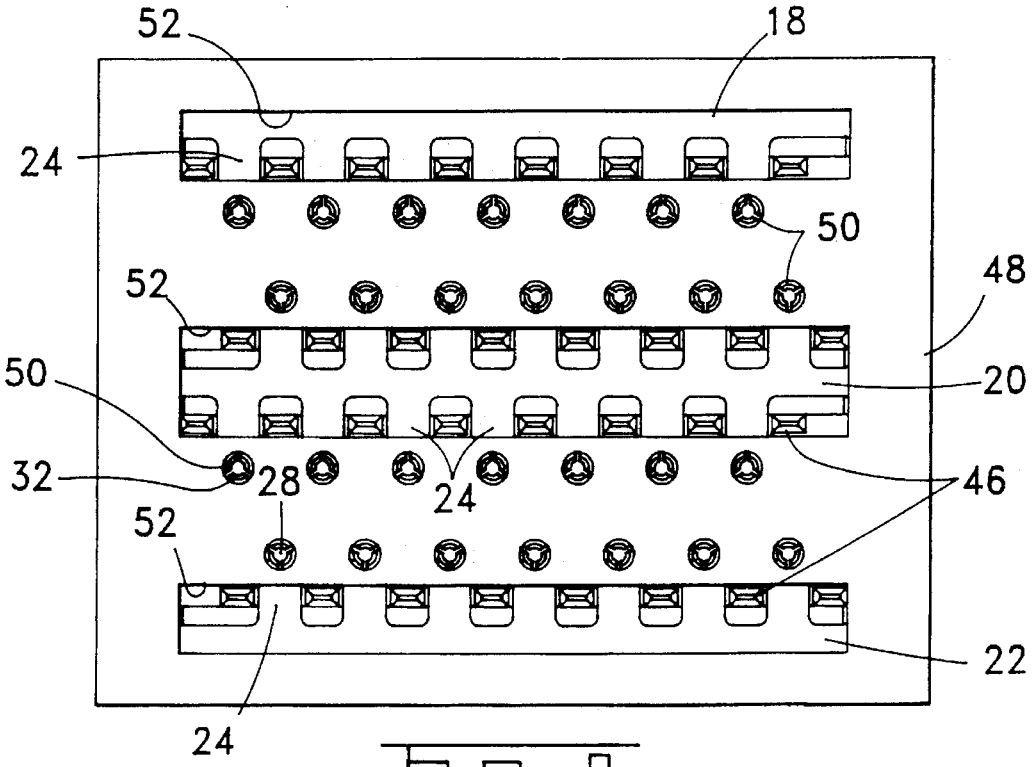
FIG. 8 is front view of the assembled insert prior to removal of material to from the lead frame to form the connecting tabs and ground buses.
Figure 9:
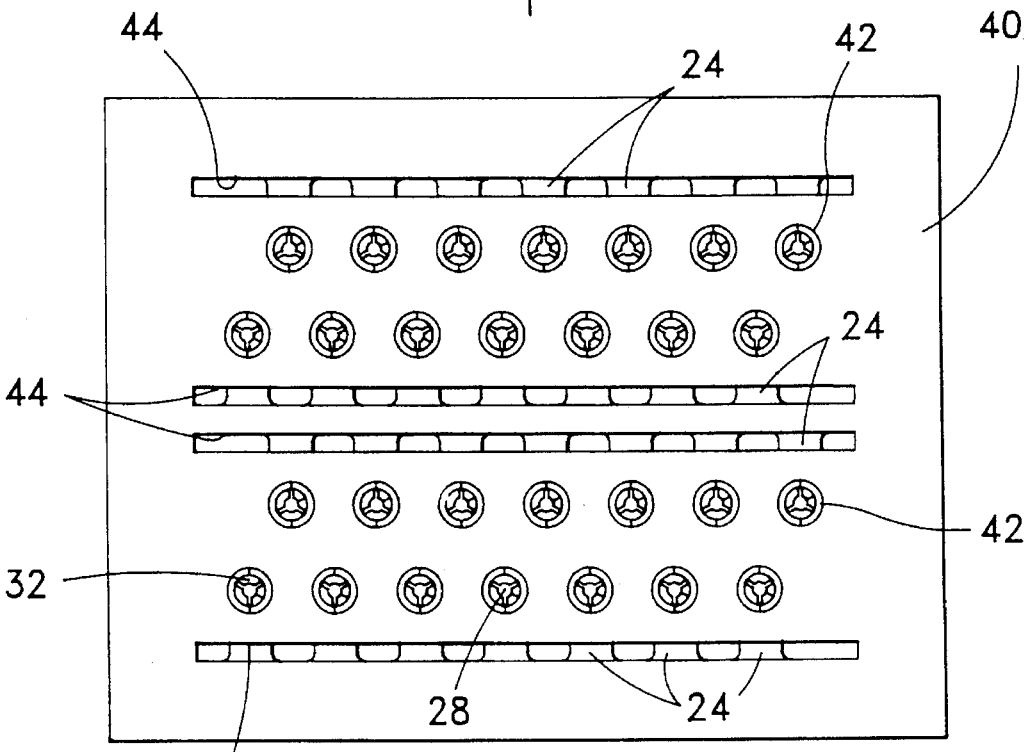
FIG. 9 is a rear view of the assembly shown in FIG. 8.

The lead frame 10 is positioned between substrate 40 and an insulative cover 48 which is preferably molded from the same material as the substrate 40. Cover terminal openings 50 extend through the cover from the front to the rear cover faces. These cover openings 50 are aligned with the substrate terminal openings 42. When the lead frame 10 is positioned between the substrate 40 and the cover 48, the terminal sockets 28 on the lead frame 10 are aligned with the openings 42, 50. Cover 48 also has three channels 52 parallel to the rows of cover terminal openings 50 and mutually parallel. The width of these cover channels 52 is greater than the width of the slots 44. The cover channels are positioned so that the periphery of the cover channels 52 envelope the periphery of the slots 44 on the substrate. The two center slots 44 are enveloped by the one center channel 52 on the cover 48. As shown in FIG. 8, at least portions of the lead frame carrier strips 18, 20, 22 are enveloped by the channels 52 so that portions of these carrier strips are exposed on the cover side of this assembly. Portions of the extensions 24 are also exposed in the channels 52 and the separation or alignment posts 46 fit into the cover channel 52. FIG. 9 shows that substantially the same portions of the extensions 24 which are exposed in the channels 52 are also exposed in the slots 44, because the channels 52 overlap the slots 44 in this area. The cover 48 is attached to the substrate 40 to secure the lead frame 16 between the two exterior members and the cover secures the lead frame 16 to the substrate 40. Conversely the substrate 40 secures the lead frame 16 to the cover 48. The cover can be attached to the substrate by any number of conventional techniques. For example, an adhesive can be used to secure the two molded members together. The cover 48 can also be ultrasonically bonded to the substrate 40 or they could be heat staked together. An interference fit would also be suitable to secure the cover to the substrate and conventional snap latches could also be added at the periphery or elsewhere. Snap latches could also be added to the separation posts 46. The lead frame 16 could also be attached directly to either the substrate 40 or the cover 48 and the other molded member could be attached to the lead frame 16 or to its companion molded member. Indeed the cover, though desirable, is not absolutely necessary and the lead frame 16 could be secured directly to the substrate only. Any number of other equivalent securing means could also be employed.

Figure 7:
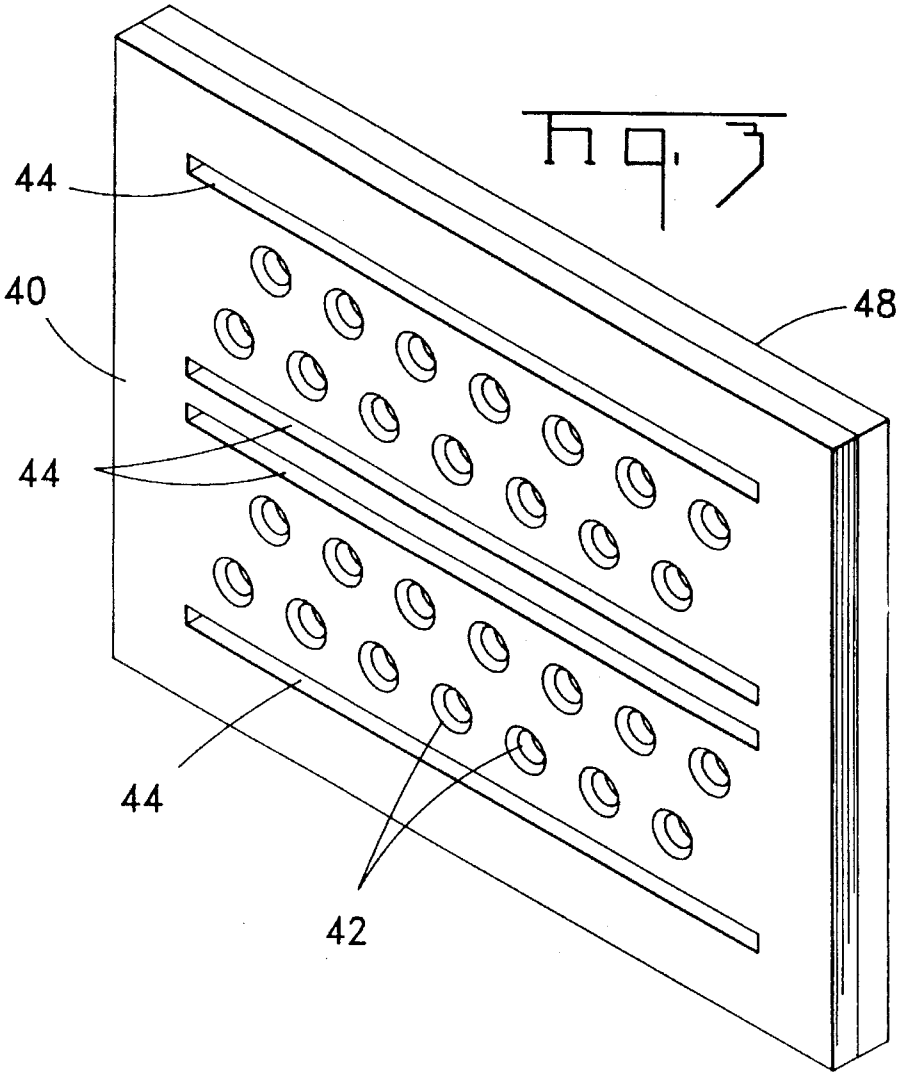
FIG. 7 is a view of a single connecting tab and opposed ground member formed from the lead frame shown in FIGS. 4–6.
Figure 10:
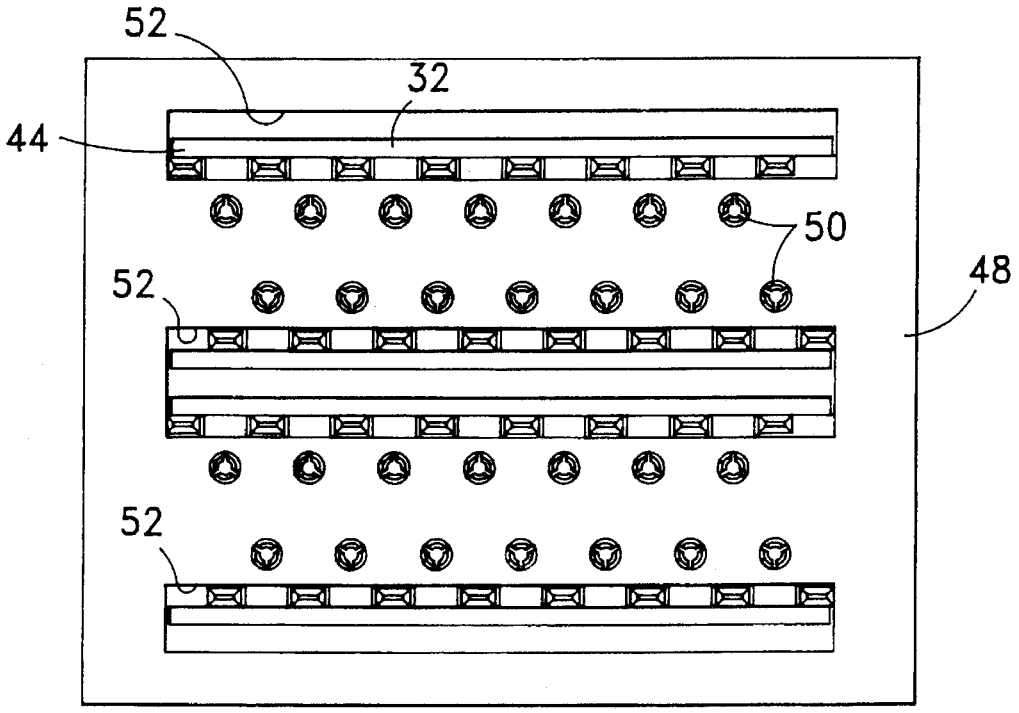
FIG. 10 is a front view similar to FIG. 8, but showing the assembly after removal of material between the connecting tabs and the opposed ground bus.
Figure 11:
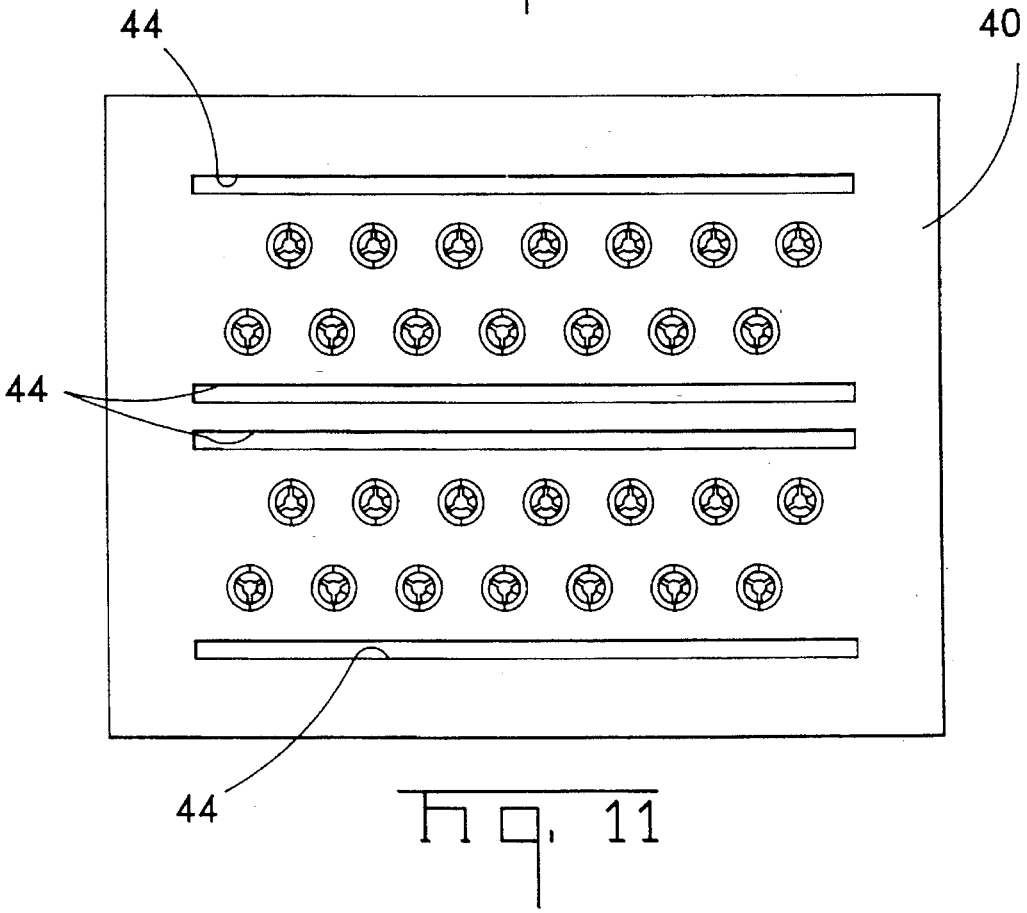
FIG. 11 is a rear view of the assembly shown in FIG. 10.
Figure 12:
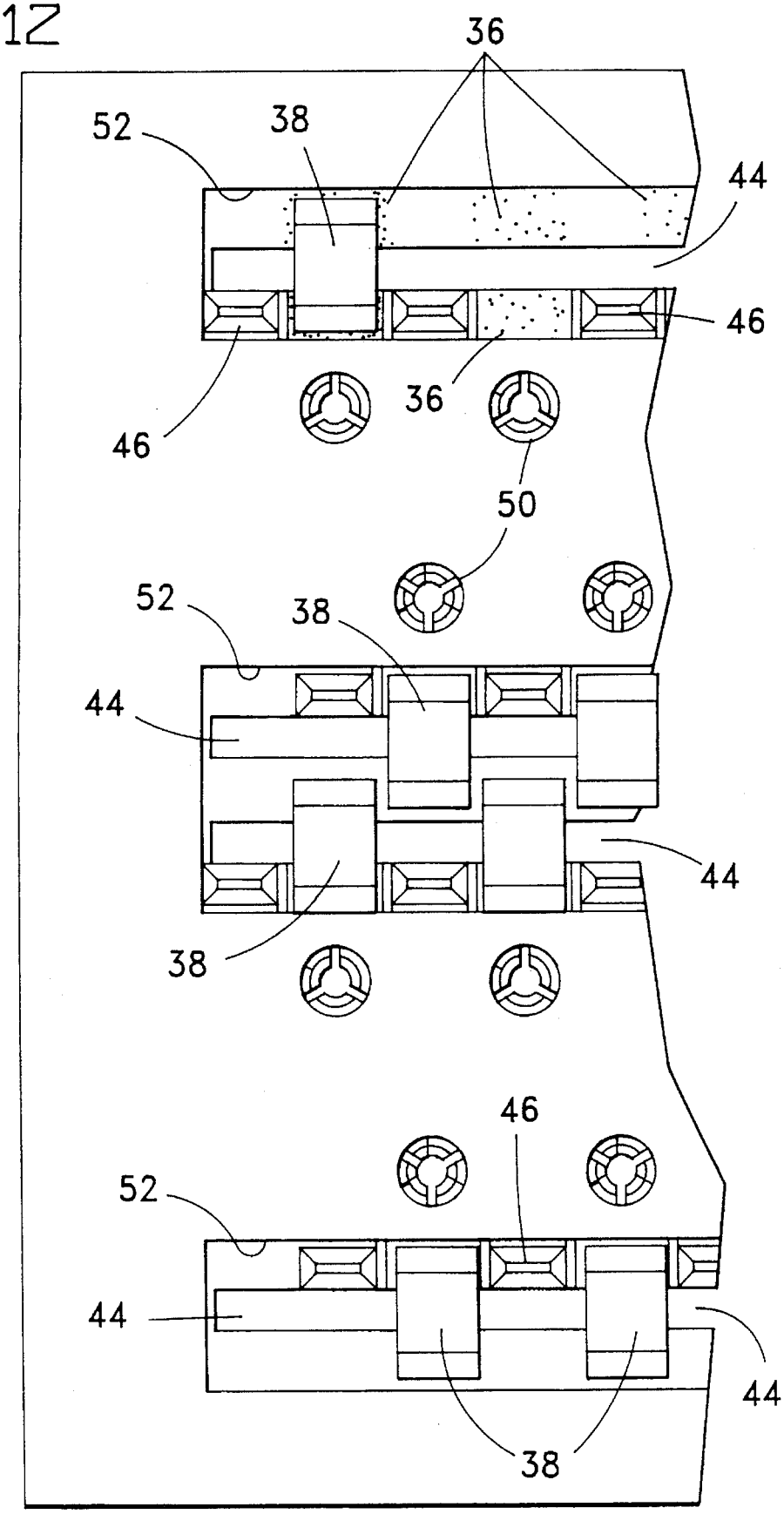
FIG. 12 is an enlarged view of front of the assembly shown in FIG. 10, showing the deposition of solder on the connecting tabs and the ground members and the placement of surface mount devices on the filtering insert.
Figure 17:
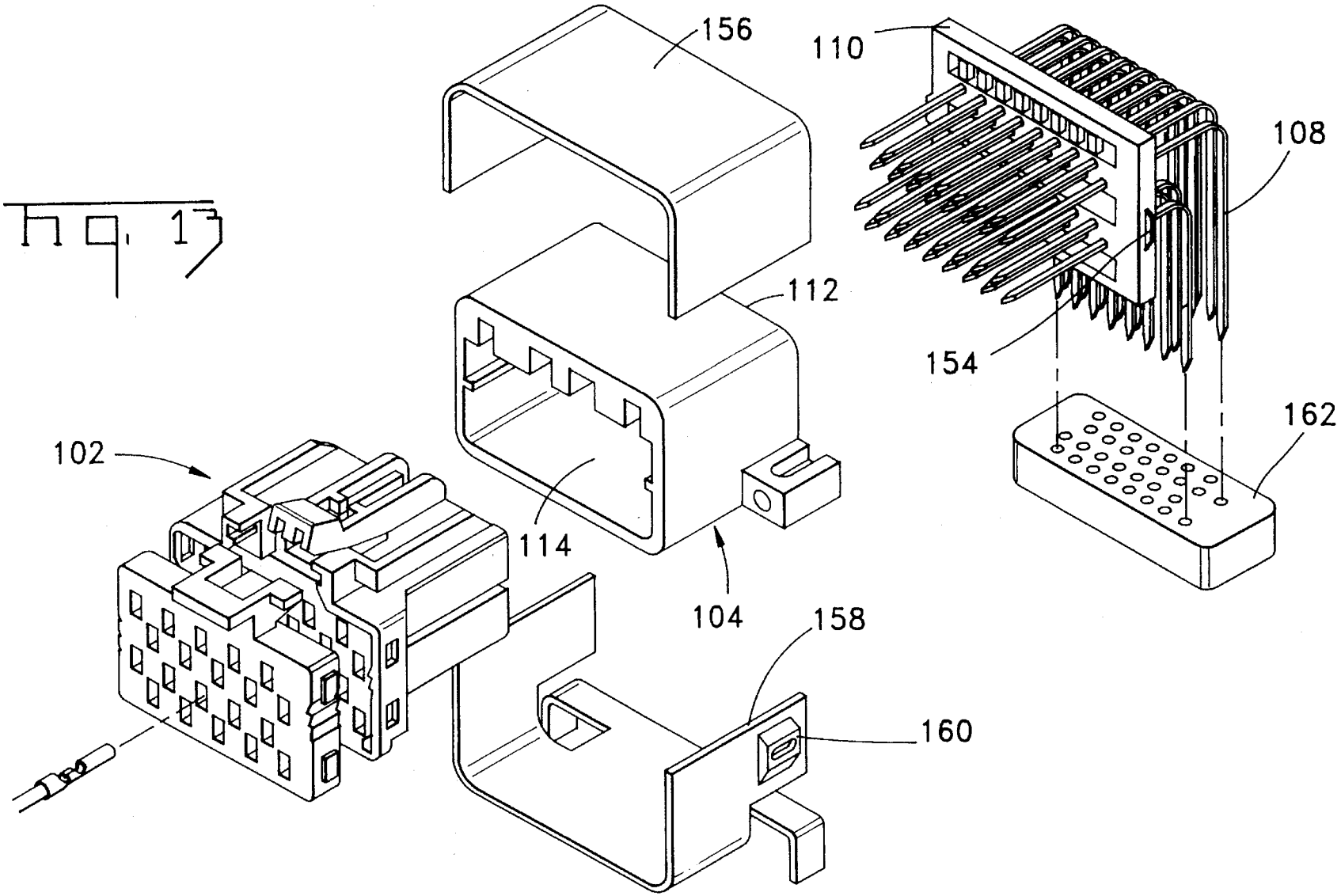

Once the lead frame 16 has been secured to the substrate 40, portions of the extensions 24 are removed to separate connecting tabs 26 from ground buses 18, 20, 22, initially carrier strips. FIGS. 10 and 11 show the manner in which the connecting tabs 26 are separated from the carrier strips 18, 20, 22. Slots 44 serve as guides for a punch (not shown) which is used to punch or stamp out portions of extensions 24 adjacent the carrier strips 18, 20, 22. Since the channels 52 overlap slots 44 there is clearance for this punch. After portions of extensions 24 have been removed, the connecting tabs 26 are formed. These connecting tabs, one of which is shown in FIG. 7, include a terminal socket 28 and a solder tab section 30. The terminal socket 28 contains the socket tines 32 and is positioned in alignment with openings 42, 50 to engage a terminal, such as pins 8. The solder tab portion is that exposed portion of extension 24 which remains after material is punched out of extension 24. The solder tab section 30 is exposed in cover channel 52 and is accessible for subsequent use. Solder tab section 30 is connected to the terminal socket 28 and is opposed to a corresponding ground bus 18, 20, 22 formed when material is removed from the extensions 24. At least a portion of the ground bus is exposed or accessible in channel 52. That portion of the respective ground bus aligned with a solder tab section 30 is referred to as the solder contact section 34 and solder deposits 36 are placed on solder tab sections 30 or on the ground bus solder contact sections 34. Solder can be deposited in any of a number of conventional ways. Solder cream or solder paste can be screened onto the solder tab sections 30 and solder contact sections 34, or it can be applied by pneumatically operated dispensers. Solder paste can be dispensed using stencils, or solder paste can be dispensed using a syringe. Solder can also be plated in these areas to form the solder deposits 34, 36. Solder flux would be used as needed. FIG. 12 shows areas in which solder would be deposited. It should be noted that solder can be dispensed all along the exposed portions of ground buses 18, 20, 22 since all components are to be soldered to ground in this embodiment. Solder contact sections 34 would of course still be those portions of the ground buses to which components are to be soldered. FIG. 12 also shows the positions occupied by selected surface mount components 38, such as surface mount capacitors.

FIG. 7 shows a single connecting tab 26 and the corresponding solder contact section 34 of the opposed ground bus. The solder deposited on solder tab section 30 and on aligned and opposed solder contact section 34 will be reflowed after a surface mount component 38 is positioned. A conventional reflow process is used to solder the surface mount component between the connecting tab 26 and the ground bus 18, 20 or 22. A wave soldering operation would require special precautions so that solder would not be deposited on the terminal sockets 28, and therefore wave soldering would not normally be used.

There are a number of ways in which the ground buses 18, 20, 22 can be connected to ground. Although not shown in this embodiment, one or more of the extensions 24 between a terminal socket 28 and the ground buses can be left intact. Since all of the ground buses are interconnecting, this one ground pin can effectively ground the buses. Alternatively a zero value surface mount resistor could be used to connect a ground pin to one of the interconnected ground buses 18, 20, 22.

Figure 14:
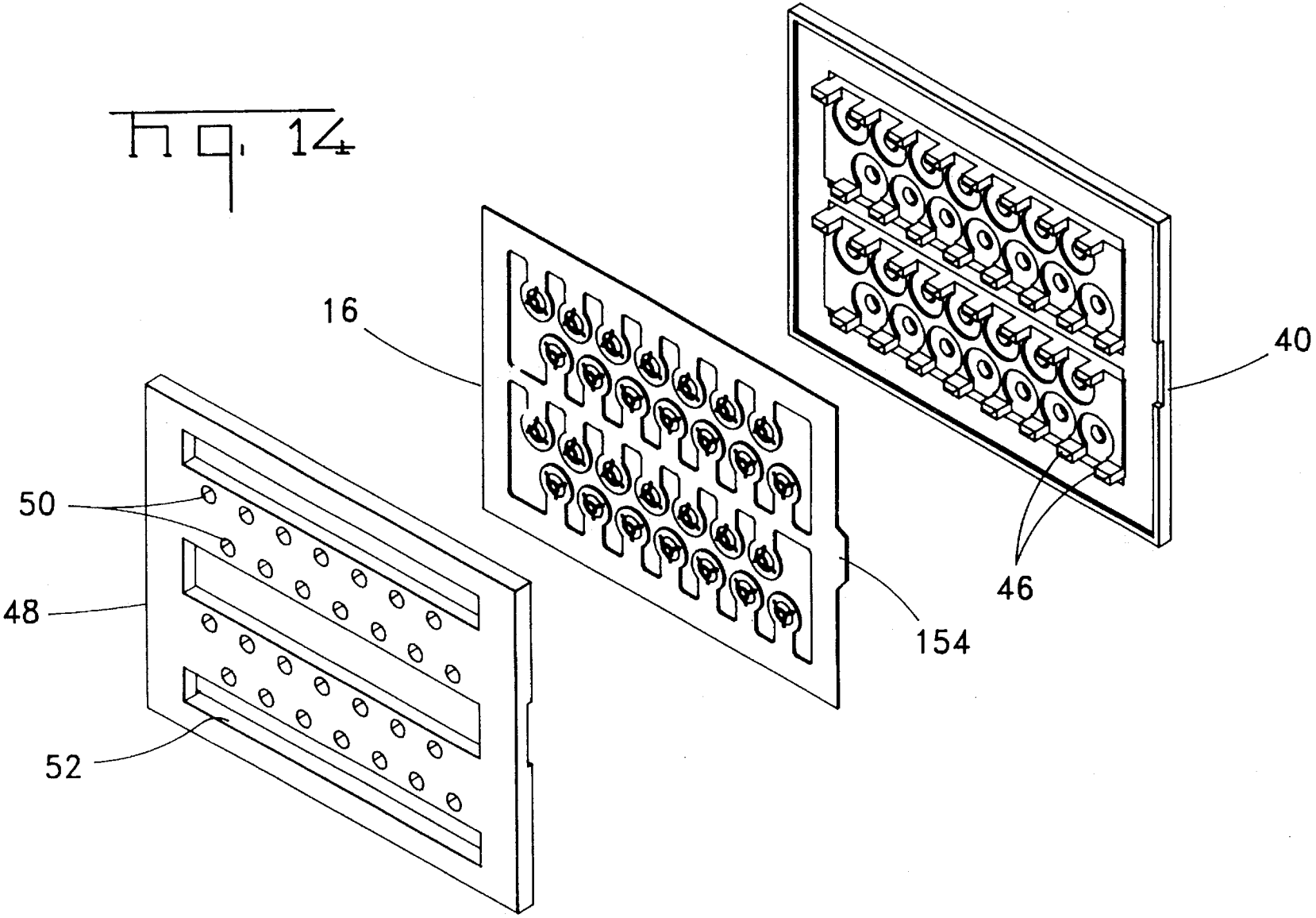
FIG. 14 is a view similar to FIG. 4 showing the embodiment of FIG. 13.

An alternative representative embodiment is shown in FIG. 13 and 14. In this second embodiment, the filter insert 110 is positioned on the rear face 112 of the electrical connector header 104 instead of at the mating face 114 between the header 104 and the receptacle. 102. This embodiment shows a shielded embodiment in which two shields 156 and 158 are positioned on the exterior of the header 104. The rear could be shielded by plating the exterior of the substrate (not shown). This filter insert 110 also includes a grounding tab 154 extending from one side of the insert. This grounding tab is part of the lead frame used to fabricate the filter insert 110 and is in a position to mate with one of the two shields 156 and 158. In this embodiment upper shield 156 and lower shield 158 fit around the exterior of the pin header 104. Lower shield 158 includes a strap 160 formed on side in position to receive grounding tab 154 and make resilient electrical contact to ground the ground buses (not shown, but otherwise the same as ground buses 18, 20, 22 for the first embodiment) to a ground shield which is in turn attached to a ground trace on the printed circuit board. In the embodiment shown herein the strap 160 forms a resilient contact with the grounding tab 154. Of course, solder could also be used to form this interconnection. This embodiment also shows the use of a ferrite plate 162 to add inductive filtering. Of course, both embodiments are compatible with the use of ferrite plates or ferrite beads to add filtering in this manner.

Although the representative embodiments of this invention are intended primarily for use in filtering circuits using conventional electrical connectors, this invention provides a simple way to add filtering to electrical connectors to be used for new and specific applications. The use of an insert of this type could also be used for applications other than filtering, since other components could be added between lines in the connector. For example a diode could be mounted on the insert instead of a capacitor. Other slight modifications could also be made to the construction of these inserts. For example, a flexible film substrate with the lead frame bonded to one surface could be substituted for the thermoplastic substrate used in the representative embodiment depicted herein. In some cases, this approach can be used in applications where special terminals must be included in the connectors. For example a terminal having an enlarged mating section to be engaged by the socket tines and a smaller noble metal plated mating section can be used in those applications where damage to the noble metal contact plating is of concern. These and similar alternative embodiments within the scope of the following claims would be apparent to one of ordinary skill in the art.

I claim:

1. A filtering insert for use with an electrical connector including terminals, the filtering insert comprising:

a plurality of stamped and formed connecting tabs, each including a terminal socket and a solder tab section;

at least one stamped and formed ground member having solder contact sections;

an insulative substrate with the connecting tabs secured to the insulative substrate with the solder tab sections being positioned adjacent to separation projections of said substrate in alignment with and spaced from the solder contact sections on the ground member; and filter components soldered to aligned ones of the solder tab sections and solder contact sections.

2. The filtering insert of claim 1 wherein each ground member comprises a ground bus.

3. The filtering insert of claim 1 wherein the filter components comprise surface mount components and the solder tab sections and the solder contact sections comprise surface mount solder tabs.

4. The filtering insert of claim 1 wherein the connecting tabs are located in multiple rows, connecting tabs in adjacent rows being staggered.

5. The filtering insert of claim 1 wherein adjacent terminal sockets are spaced apart by a centerline to centerline distance of 3 mm.

6. The filtering insert of claim 1 wherein both the connecting tabs and each ground member is secured to the insulative substrate.

7. The filtering insert of claim 6 wherein the connecting tabs and each ground member is stamped and formed from the same flat blank.

8. The filtering insert of claim 1 further comprising a cover attached to the substrate to secure the connecting tabs to the substrate.

9. The filtering insert of claim 8 wherein the cover includes openings in which the filter components are mounted.

10. The filtering insert of claim 1 wherein each terminal socket comprises resilient tines formed transversely of a plane occupied by said solder tab section.

11. The filtering insert of claim 10 wherein said resilient tines converge radially inward toward the socket center.

12. The filtering insert of claim 11 wherein said insulative substrate includes an opening enveloping the socket center and at least a portion of said tines.

13. The filtering insert of claim 12 further including a cover securing the connecting tabs to the substrate, the cover including an opening aligned with the opening in the substrate, the tines in each socket extending at least partially into a corresponding opening in one of either the cover or the substrate.

14. The filtering insert of claim 1 wherein said substrate includes at least one slot located between aligned ones of the solder tab sections and solder contact sections.

15. The filtering insert of claim 14 further including a cover having a channel aligned with each slot.

16. The filtering insert of claim 15 wherein each channel envelops aligned ones of the solder tab sections and solder contact sections.

17. The filtering insert of claim 16 wherein the filter components are located in said channels.

18. The filtering insert of claim 17 wherein the substrate includes separation posts adjacent each of the slots, the separation posts being positioned between adjacent solder tab sections and spaced from said solder contact sections.

19. The filtering insert of claim 1 wherein the connecting tabs and the ground member are sections of a lead frame, portions of the lead frame between aligned ones of the solder tab sections and solder contact sections having been removed.

20. The filtering insert of claim 19 wherein each ground member comprises a carrier strip section of the lead frame initially joining multiple connecting tabs, the removed portions, between aligned ones of the solder tab sections and solder contact sections, initially comprising portions of individual extensions from the carrier strip sections initially joining each terminal socket to an adjacent carrier strip section.

21. An insert subassembly, for use in fabricating a filtering insert for use with an electrical connector, the insert subassembly comprising:

a plurality of stamped and formed connecting tabs, each including a socket and a solder tab section;

at least one stamped and formed bus having solder contact sections;

an insulative substrate with the connecting tabs secured to the insulative substrate with the solder tab sections being positioned adjacent to separation projections formed on said substrate and in alignment with and spaced from solder contact sections on the bus; and solder deposits on the solder tab sections and on the solder contact sections, whereby individual surface mount components can be soldered between aligned solder tab sections and solder contact sections for the fabrication of a filtering insert for use with an electrical connector having a plurality of terminals.

22. The insert subassembly of claim 21 further including a cover attachable to the insulative substrate to secure the connecting tabs and the ground member to the insulative substrate.

23. The insert subassembly of claim 22 wherein the cover includes at least one channel enveloping a plurality of individually aligned solder tab sections and solder contact sections.

24. A filtering insert for use with an electrical connector including a plurality of terminals, the filtering insert including a plurality of individual filter components soldered between terminal contacts in the filtering insert and ground members in the filtering insert, characterized in that:

the terminal contacts comprise terminals sockets joined to solder tab sections on stamped and formed connecting tabs, the ground members comprise stamped and formed members having solder contact sections, and the terminal contacts and the ground members are secured to an insulative substrate having a slot extending between aligned solder tab sections and solder contact sections to which individual filter components are soldered said tab and contact sections being disposed between separation projections formed adjacent thereto.

* * * * *